US006795983B2

(12) United States Patent
Brown et al.

(10) Patent No.: US 6,795,983 B2
(45) Date of Patent: Sep. 28, 2004

(54) IMMERSIBLE TUB

(76) Inventors: Peter Edward Brown, 43 Kevin Crescent, Thornton, On. (CA), L0L 2N0; Paul Gordon Burke, 234 Barrie Street, Thornton, On. (CA), L0L 2N0

( * ) Notice: Subject to any disclaimer, the term of this patent is extended or adjusted under 35 U.S.C. 154(b) by 0 days.

(21) Appl. No.: 10/323,814

(22) Filed: Dec. 20, 2002

(65) Prior Publication Data

US 2004/0117902 A1 Jun. 24, 2004

(51) Int. Cl.[7] ..... A47K 3/00
(52) U.S. Cl. ..... 4/487; 4/507
(58) Field of Search ..... 4/487, 489, 507; 441/130, 131, 132

(56) References Cited

U.S. PATENT DOCUMENTS 4,126,905 A * 11/1978 Russell et al. ..... 4/489 X
4,149,281 A * 4/1979 Bob et al. ..... 4/487
4,152,791 A * 5/1979 Rose ..... 4/487

* cited by examiner

*Primary Examiner*—Robert M. Fetsuga
(74) *Attorney, Agent, or Firm*—Douglas W. Eggins

(57) ABSTRACT

A submersible fabric tub is floated in a swimming pool or other body of water, the tub having an upper floatation collar from which the flexible fabric structure of the tub is suspended. The tub has a pair of opposed bench seat portions with a deeper leg well located between them, and with enclosing end walls. A pair of access ports in an end wall connect by way of connecting hoses with an external heating or cooling water supply, by which the temperature of the water within the tub structure may be conditioned to a desired extent. The flexible floatation collar can be readily locally depressed, enabling users of the tub to readily enter or leave the tub for the surrounding body of water by swimming over the collar. The bench seat portions incorporate plastic reinforcing beams.

8 Claims, 6 Drawing Sheets

IMMERSIBLE TUB

CROSS-REFERENCE TO RELATED APPLICATIONS

NOT APPLICABLE (N/A)

STATEMENT REGARDING FEDERALLY SPONSORED RESEARCH OR DEVELOPMENT (N/A)

REFERENCE TO A: SEQUENCE LISTING, TABLE, OR COMPUTER PROGRAM LISTING (N/A)

COMPACT DISC APPENDIX (N/A)

BACKGROUND OF THE INVENTION

1. This invention is directed to a flexible submersible tub/spa apparatus for use in semi-submerged relation in a body of ambient water such as a swimming pool, the tub being filled with conditioning water at a higher or lower temperature than ambient.

2. Portable Hot tubs/spas are commonly known and widely used.

Portable tubs may have rigid or inflated free-standing support structures with supported enclosure walls that contain the hot water, as shown in Canadian patents: CA 2120673 and CA 1060154, and in U.S. patent application Ser. Nos. 205,624 and 270,589 respectively. These earlier types of hot tub have achieved considerable popularity and commercial success. They are usually characterized by the weight and mass of the support structure, including the water-impermeable walls that contain the contents of the tub. In the case of rigid wall types of hot tubs, and also the type of tub having a large diameter inflated rim, with outwardly inclined elastomer walls, there is considerable weight and mass to the structure.

Also, in the case of most of these prior art hot tubs, there is required either a rigid deck or a walkover set of steps, providing access for users to the tub.

BRIEF SUMMARY OF THE INVENTION

The present invention provides a unique, open-ended, flexible-wall containment vessel, which floats self-suspended, open-end up, at the surface of a pool of water, to contain conditioning water at a temperature different from that of the ambient pool water.

The floating vessel is generally filled with water from the pool in which it floats, and this tub-contents water is circulated and thermally conditioned, generally by being heated, from an external source.

However, in extremely hot climates the circulated containment water may be cooled below the ambient temperature of the supporting pool water.

The configuration of the containment vessel is maintained by way of a two-way through-wall extraction valve, at the convenience of the occupants.

The subject tub-vessel has contour-formed flexible seating.

In operation, users of the tub, such as bathers may freely enter and exit the vessel from any direction simply by depressing and swimming over its flexible floating upper barrier/rim. The substantially neutral buoyancy of the tub structure, allied with the flexibility of the structure greatly facilitates this use, while minimizing heat losses across the wall of the structure by way of water transfer.

The preferred embodiment of tub structure incorporates sheet material of a durable heavy gauge nylon, having an ultra-violet (u/v) protective-coating.

The weight of the tub structure is offset by the provision of moulded floatation material of closed cell polyethylene foam.

The hydraulic fittings are preferably of moulded polymeric material, and include a novel spool valve for selective removal and recirculation of water to/from the immersed tub.

BRIEF DESCRIPTION OF THE SEVERAL VIEWS OF THE DRAWINGS

Certain embodiments of the present invention are described by way of illustration, without limitation thereto other than as set forth in the following claims; reference being made to the accompanying drawings, wherein:

DETAILED DESCRIPTION OF THE INVENTION

Figure 1:
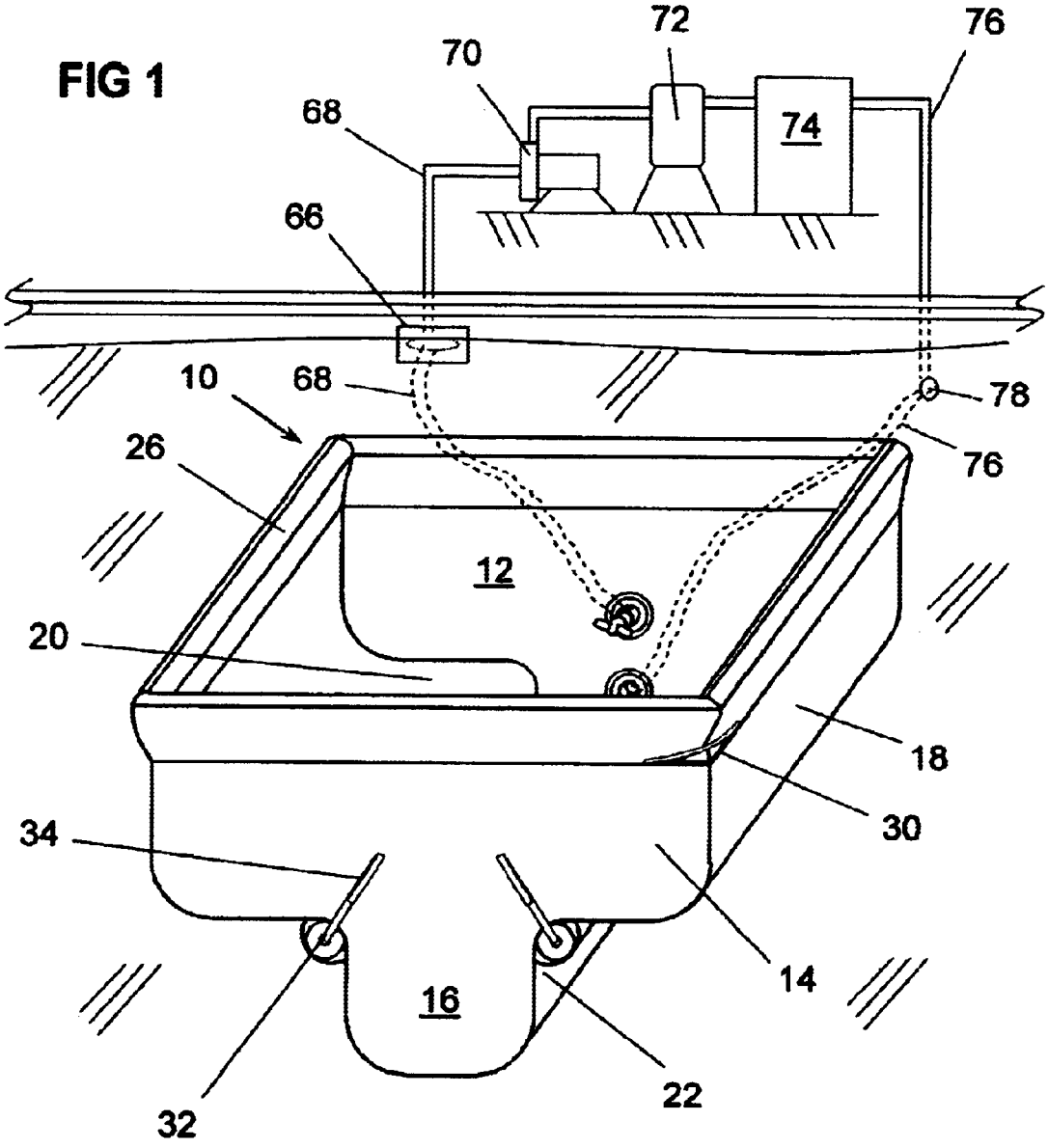
FIG. 1 is a semi-diagrammatic, perspective view of the subject floating tub enclosure in accordance with the present invention, shown from above, looking down into the vessel, shown in an in-use condition.
Figure 2:
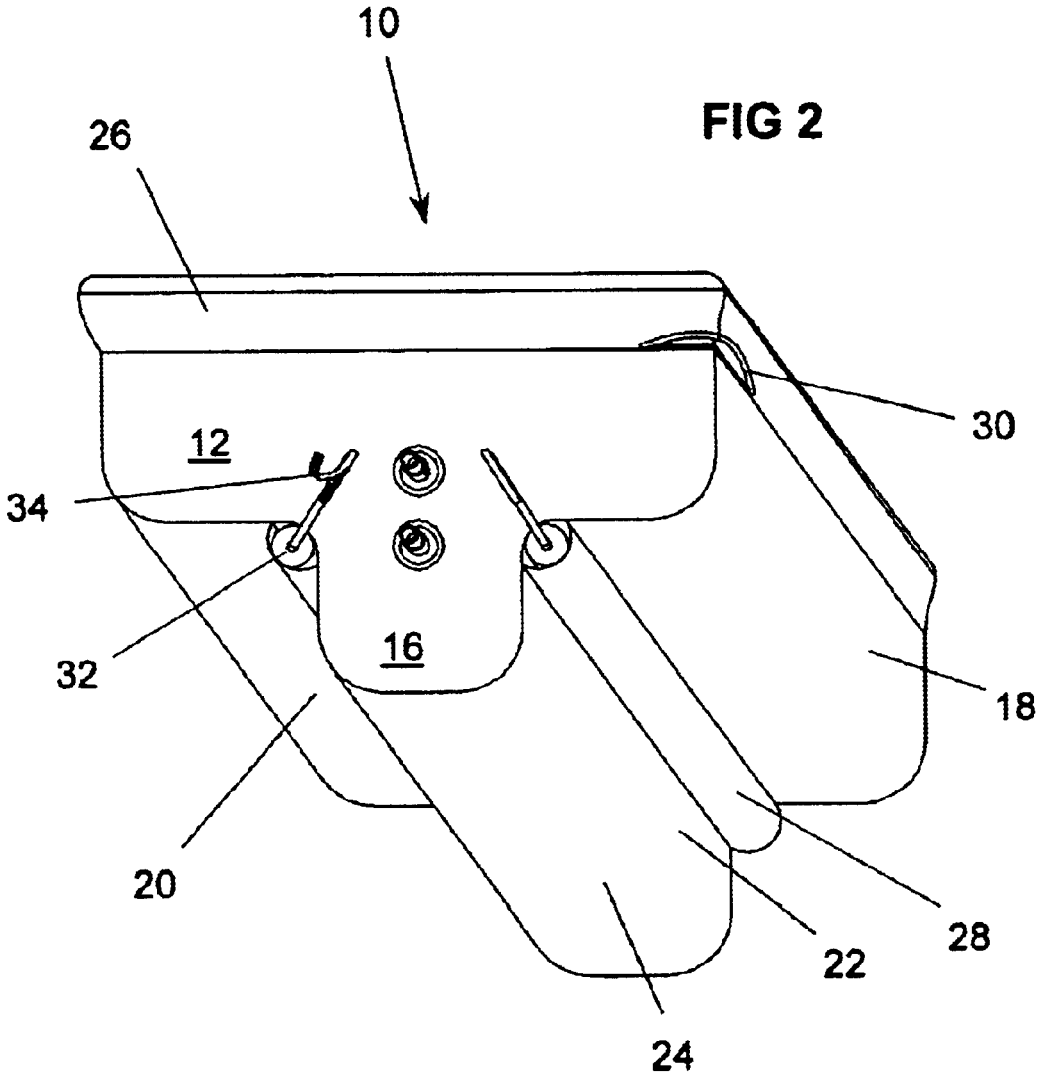
FIG. 2 is a view similar to FIG. 1, taken from below.
Figure 3:
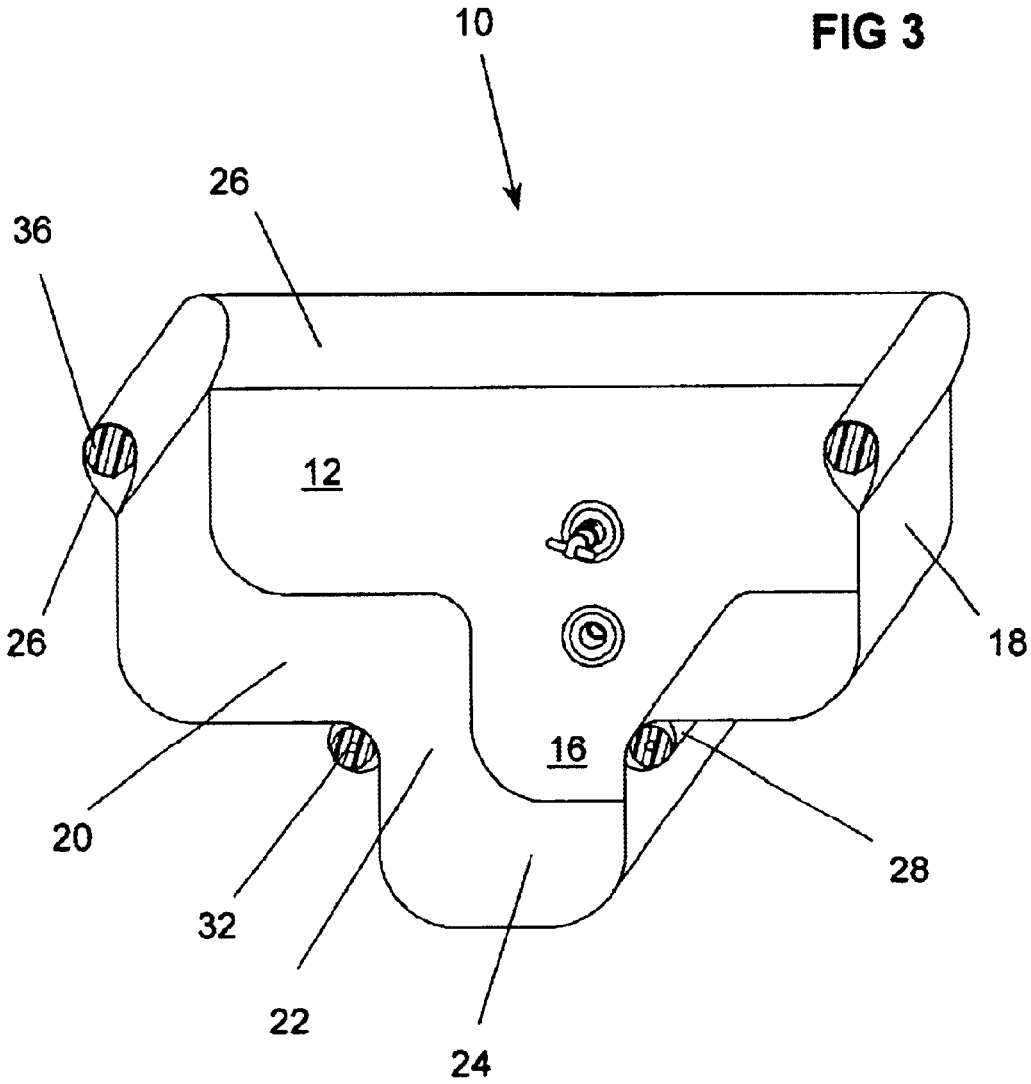
FIG. 3 is a cross-sectional view of FIG. 1, showing the floatation collar with buoyancy means contained therein, and the seating and well provisions.

Referring to FIGS. 1, 2 and 3, the subject floating tub 10 has opposed end walls 12, 14, each with a well portion 16; and side walls 18 that include seat portions 20 and well side portions 22 and bottom portion 24.

An enlarged floatation collar portion 26 encloses the tub 10.

In the illustrated embodiment, the floatation collar 26 is formed in part by upper portions of the end and side walls 12, 14 and 18, folded to form a peripheral enclosure, with light weight buoyancy means 36 contained therein.

The collar 26 may have access hatch portions 30, with hook and loop closure means to provide ready access thereto. A pair of occupant support beams 32 (see FIG. 2) located externally of the tub 10, connect the end walls 12, 14. The beams 32 each comprises a substantially stiff, hollow polymeric material tube coated with closed cell type polyethylene foam, to provide limited buoyancy to the beams 32.

The beams 32, are each attached at both ends by nylon hanger-straps incorporating hook and loop end fittings 34 that are joined to the end walls 12, 14 of the tub 10. The hook and loop, fittings may be in the form of a three-layer sandwich, having a pair of back-to-back mutually engaging surfaces, to provide enhanced security, and to substantially preclude accidental release of the fittings 34.

The beams 32 are each locally positioned within a retention sleeve 28 that is attached along each edge to both the seat portions 20 and the well side portions 22, being thus located externally of the tub 10 enclosure, outboard of the seat portion 20 and the well side portions 22.

The buoyancy provided by the floatation collar portion 26 and the beams 32 is sufficient to maintain the tub 10 afloat, in a substantially submerged condition of almost neutral buoyancy. In use, this maintains the interior "conditioning" water content of the tub 10 substantially isolated from the surrounding, supporting "ambient" body of water, while enabling local depression of the collar portion 26 to facilitate swimming passage thereover by a user of the tub.

An external conditioning water supply is provided, consisting of a water return line 68 connecting the tub 10, by way of pool skimmer connection 66 with a pump/motor 70. The output hose of pump/motor 70 connects in series with a filter 72 and heater 74, the output hose 76 of which connects to the tub 10, through a water delivery jet connector 78.

Figure 4:
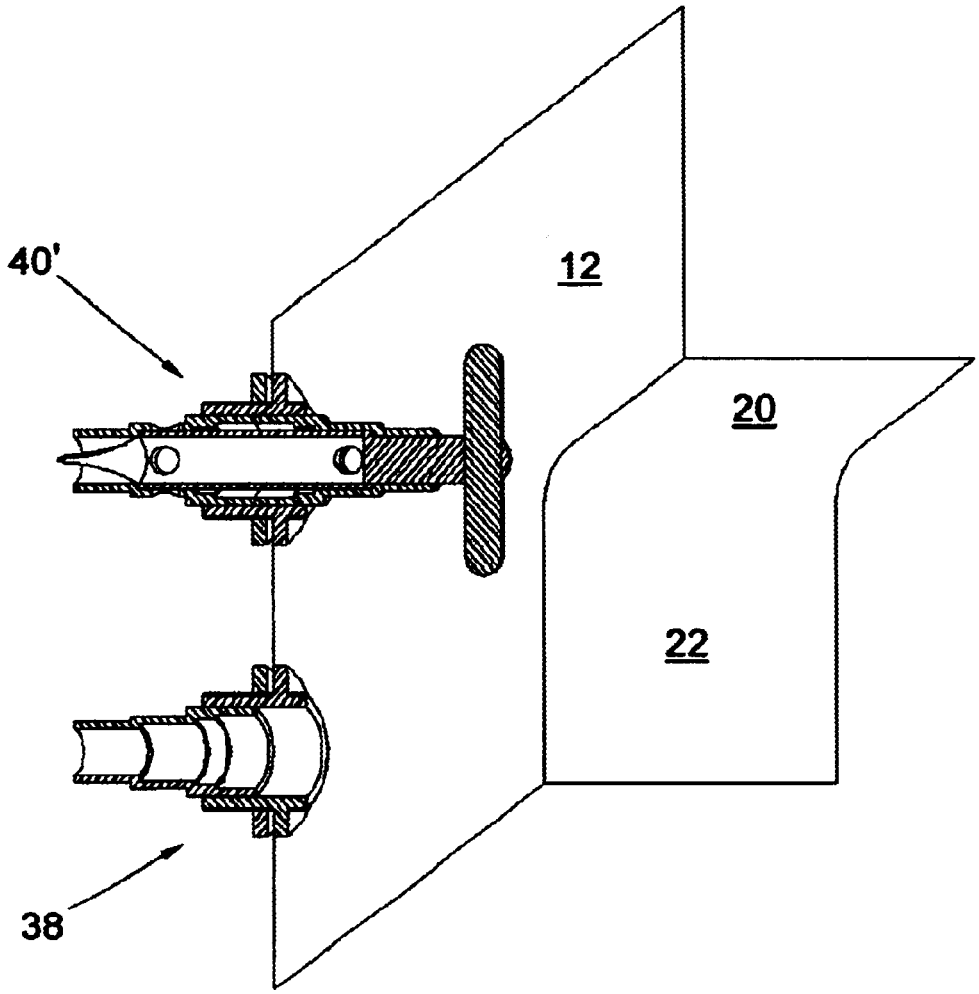
FIG. 4 is a perspective-sectioned view showing the water inlet and extraction valve provisions of the subject tub.

Referring to FIG. 4, a first through-wall hose connection 38 provides for the supply of water and a second connection 40 provides for water extraction, being preferably installed through one of the end walls 12/14 to provide thermal circulation connections, thus enabling the coupling of the tub 10 to a hot or to a cold water supply, (not shown) for the transfer and circulation of conditioning water into and through the immersed, floating tub.

As previously stated, the conditioning water temperature within the tub 10 may be made higher or lower than the ambient temperature, that of the surrounding body of water, in accordance with the type of installation required, and the elective provision of a heating or of a cooling source. The use of tub conditioning water that is cooler than ambient is envisaged in situations such as hot springs and the tropics, where ambient water temperatures can reach 50° F. degrees.

Figure 5:
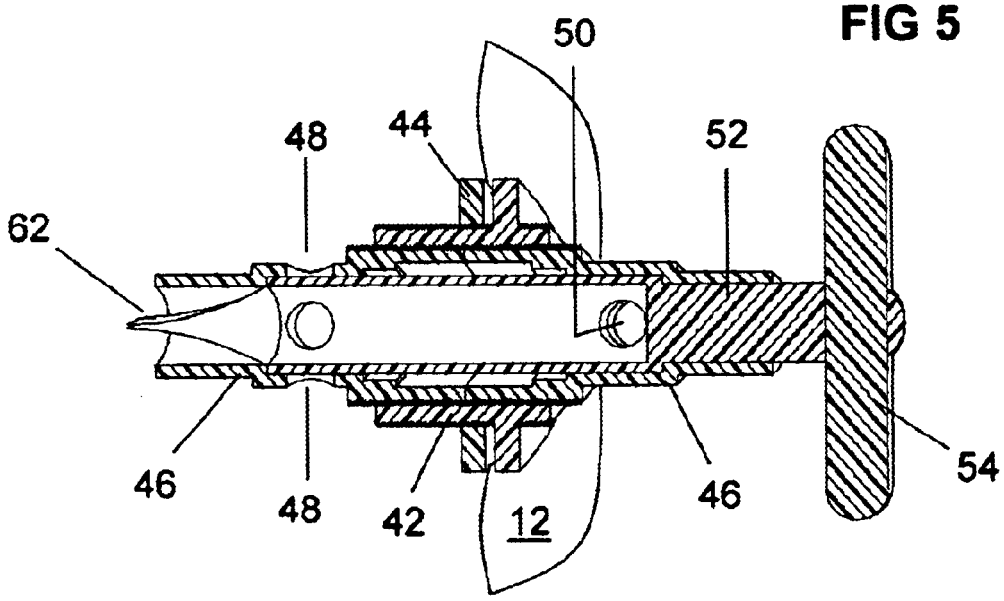
FIG. 5 is an enlarged sectioned view of the water extraction valve of FIG. 4.
Figure 6:
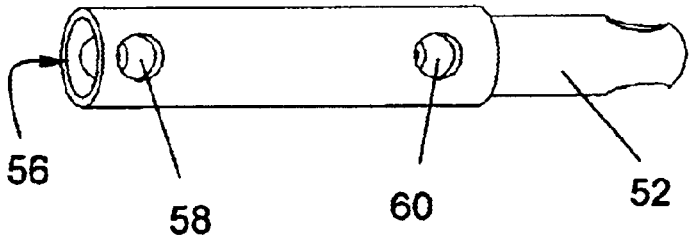
FIG. 6 is a perspective view of the spool portion of the FIG. 4 extraction valve.
Figure 7:
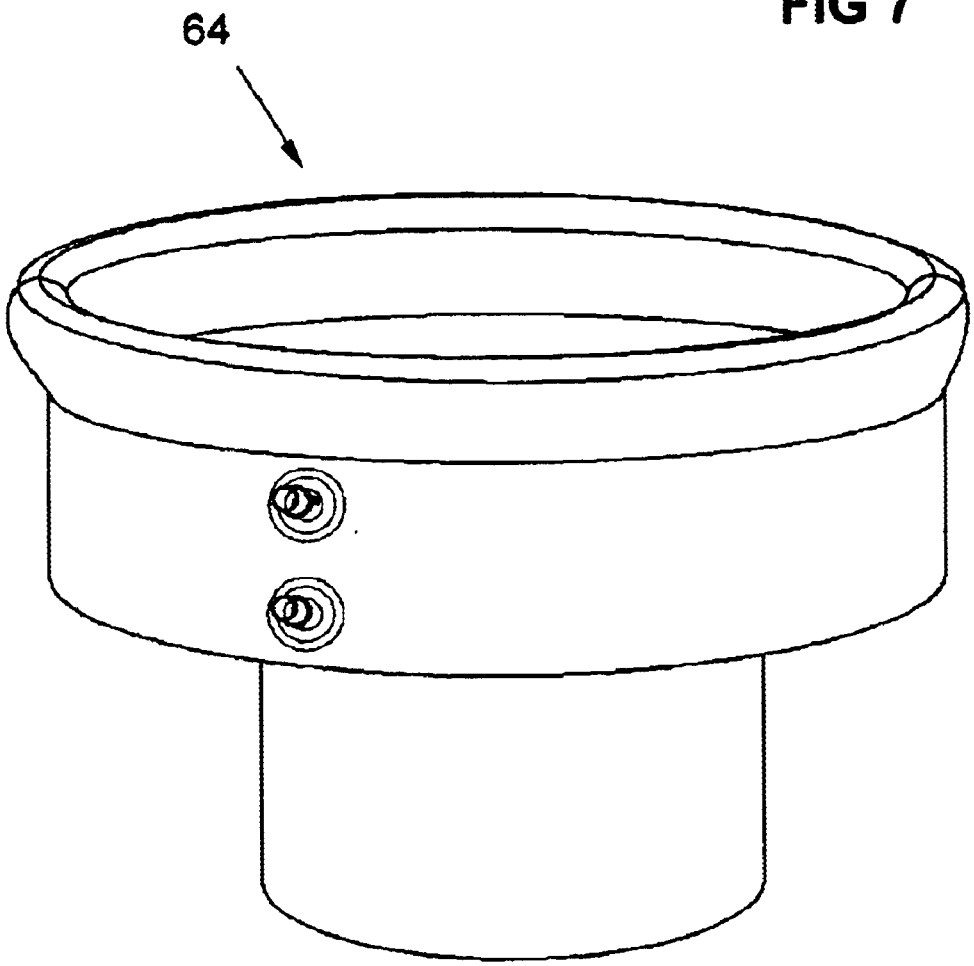
FIG. 7 is a perspective view of the tub in a round configuration.

Referring also to FIGS. 5 and 6, a through-wall coupling 42 is passed through a clearance hole in the tub side wall 12.

The coupling 42 is then secured to the side wall 12 by means of a lock nut 44.

Two hose connection half-casings 46 are threaded into the opposed ends of the through wall coupling threaded bore, to meet mid-way.

Through-ports 48 and 50 extend transversely, one through each of the valve casings 46, having their respective polar axes mutually offset at 90 degrees to each other. A hollow valve spool 52 is axially slidable and rotatably mounted within the valve casings 46; the valve spool 52 having transverse through-ports to match the ports 48 and 50 of the casings 46, however the valve spool through-ports are co-planar, thus enabling a simple 90 degree rotation of the valve spool 52 by way of T-handle 54 to connect either the distal or the proximal ports 48,50 with the central bore of valve spool 52, thereby enabling the selective connection of the extraction valve 40' with either conditioned water from the immersed tub 10, or the ambient water, to thereby control the temperature of the water within the tub. The central bore of the valve spool 52 connects by way of a hose connection 68 with the inlet of the circulation pump for the conditioning water.

The resulting connections enable hydraulic extraction to be effected distally (for ambient water) or proximally (for conditioned water) from within the immersed tub 10, for the purposes of providing ambient water to the water heater/cooler for replenishment, or for re-circulating the conditioned water from the floating tub 10 to the waterheater/cooler.

A reed style-check valve 62 is mounted in the exit port of the valve 40 to assist in maintaining the priming in the extraction hose, and the prime of the system pump, to faciltate start-up; the pump being usually located above the water level for other than an above ground pool. The ports 48, 50 and 58 and 60 are of sufficient diameter to ensure that at no anguilar position of the valve spool 52 is there a full cut-off in the hydraulic connection.

A typical "family" sized pool might be some five feet wide by five feet long or five feet in diameter, with the seat some sixteen inches below the collar, and the well some sixteen inches deep.

In the case where the conditioning water is heated, a typical pool heater has ample capacity to heat the conditioning water of a subject "family size" tub in an hour.

Where the ambient water is a lake, river or pool, the exchange of conditioning water with ambient water under active use conditions, with ingress and egress of tub users over the locally depressed rim of the tub, generally obviates the need for chemical treatment of the conditioning water.

A lanyard is provided, for anchoring the tub 10 in a desired location, and to minimise tension loads on the connecting water transfer hoses.

The lightweight construction, allied with the absence of a supporting structure for the subject immersible floating tub 10, and the flexibility of the sheet material construction permits extreme portability and transportability, with rapid assembly and disassembly.

From a commercial standpoint, handling, packaging and transportation costs are minimized.

What is claimed is:

1. A submersible, flexible tub for use in a supporting body of ambient water, said tub having a peripheral upper floatation collar; flexible side, end and bottom wall portions depending downwardly from the floatation collar and together therewith forming a water enclosure; at least one said side wall having an in-turned portion forming a seat; a leg well extending downwardly from the seat; beam means located externally of said tub interior and supported by said end walls, to provide enhanced support to said seat; through-wall coupling means connecting with said water enclosure for connection with an external conditioning water supply, by which, in use, the temperature of the water within the tub enclosure may be changed to a desired extent from the temperature of the ambient water.

2. The tub as set forth in claim 1, having two said in-turned seat portions in mutually facing relation.

3. The submersible tub as set forth in claim 2, said floatation collar having upper portions of said side and end walls folded to form a peripheral enclosure, with light weight buoyancy means contained therein.

4. The submersible hot tub as set forth in claim 2, said floatation collar peripheral enclosure having access hatch portions.

5. The submersible hot tub as set forth in claim 4, said floatation collar access hatch portions having hook and loop closure means to provide ready access thereto.

6. The submersible tub as set forth in claim 1, having a through-wall hydraulic water-supply connection, and a manually adjustable through-wall hydraulic two-way extraction valve for conditioned tub water and ambient water, to enable selective control of the temperature of water within the tub.

7. A submersible, flexible tub for use in a supporting body of ambient water, said tub having a peripheral upper floatation collar; flexible side, end and bottom wall portions depending downwardly from the flotation collar and together therewith forming a water enclosure; at least one said side wall having an in-turned portion forming a seat; a leg well extending downwardly from the seat; beam means having local positioning retention sleeves and being located externally of said tub interior and supported by said end walls, to provide enhanced support to said seat; water supply and water extraction means connecting with said water enclosure for connection with an external conditioning water supply, by which, in use, the temperature of the water within the tub enclosure may be changed to a desired extent from the temperature of the ambient water.

8. A submersible, flexible tub for use in a supporting body of ambient water, said tub having a peripheral upper floatation collar; flexible side, end and bottom wall portions depending downwardly from the flotation collar and together therewith forming a water enclosure; at least one said side wall having an in-turned portion forming a seat; a leg well extending downwardly from the seat; beam means having support means incorporating hook and loop end fittings, being located externally of said tub interior and supported by said end walls, to provide enhanced support to said seat; water supply and water extraction means connecting with said water enclosure for connection with an external conditioning water supply, by which, in use, the temperature of the water within the tub enclosure may be changed to a desired extent from the temperature of the ambient water.

* * * * *